US009826823B1

(12) United States Patent
Velazquez et al.

(10) Patent No.: US 9,826,823 B1
(45) Date of Patent: Nov. 28, 2017

(54) HEATED SHAVING BRUSH ASSEMBLY

(71) Applicants: Francisco A. Velazquez, Miami, FL (US); Hector Roig, Miami, FL (US)

(72) Inventors: Francisco A. Velazquez, Miami, FL (US); Hector Roig, Miami, FL (US)

( * ) Notice: Subject to any disclaimer, the term of this patent is extended or adjusted under 35 U.S.C. 154(b) by 285 days.

(21) Appl. No.: 14/848,509

(22) Filed: Sep. 9, 2015

Related U.S. Application Data

(63) Continuation-in-part of application No. 13/749,901, filed on Jan. 25, 2013, now abandoned.

(51) Int. Cl.

| | |
|---|---|
| ***A45D 27/04*** | (2006.01) |
| ***A46B 11/00*** | (2006.01) |
| ***B65D 83/28*** | (2006.01) |
| ***A45D 26/00*** | (2006.01) |
| ***A45D 34/04*** | (2006.01) |
| ***A46B 3/00*** | (2006.01) |
| ***A46B 11/08*** | (2006.01) |

(52) U.S. Cl.
CPC ..... *A46B 11/08* (2013.01); *A45D 27/04* (2013.01); *A45D 26/00* (2013.01); *A46B 3/00* (2013.01)

(58) Field of Classification Search
CPC ..... A45D 27/04; A45D 2200/109; A45D 2200/155; A46B 11/08; A46B 11/00; A46B 1/00
USPC ..... 401/1
See application file for complete search history.

(56) References Cited

U.S. PATENT DOCUMENTS

| | | | | | |
|---|---|---|---|---|---|
| 1,556,245 | A * | 10/1925 | Newlon | A45D 27/04 | 132/290 |
| 1,813,616 | A * | 7/1931 | Frazier | A46B 11/08 | 401/1 |
| 1,950,155 | A * | 3/1934 | Statham | A45D 27/04 | 222/105 |
| 3,388,958 | A * | 6/1968 | Johnson | A45D 27/04 | 132/290 |
| 3,495,922 | A * | 2/1970 | Steinman | A46B 11/0017 | 222/402.1 |
| 3,822,434 | A * | 7/1974 | Mahoney | A45D 27/04 | 15/160 |
| 4,533,273 | A * | 8/1985 | Obata | A46B 3/005 | 401/190 |
| 4,753,547 | A * | 6/1988 | Dodero | A45D 27/04 | 401/190 |
| 4,938,621 | A * | 7/1990 | Pyrozyk | A46B 11/0017 | 132/112 |
| 6,003,523 | A * | 12/1999 | Nettlefold | B65D 83/285 | 132/289 |
| 7,695,207 | B1 * | 4/2010 | Laghi | A46B 11/001 | 401/1 |

(Continued)

*Primary Examiner* — Allana Lewin Bidder
*Assistant Examiner* — Thomas M Abebe
(74) *Attorney, Agent, or Firm* — Sachelima & Associates, P.A.; Christian Sanchelima; Jesus Sanchelima

(57) ABSTRACT

A heated shaving brush having a housing with an interior space that houses a shaft that acts as a tube to allow shaving cream or similar lubricating agent to pass through to a bristle assembly that a user applies to their body. The shaft is adjacent to a heating element that is powered by alternating or direct current, thereby heating the shaving cream as it passes through the hollowed shaft. A graduated knob can modulate the speed at which the shaving cream passes through the shaft, thereby increasing or decreasing the temperature of the shaving cream before it is applied to a user's face.

15 Claims, 9 Drawing Sheets

(56) References Cited

U.S. PATENT DOCUMENTS

| | | | | |
|---|---|---|---|---|
| 8,794,249 | B2 * | 8/2014 | Gerber | A46B 11/08 132/290 |
| 2012/0109041 | A1 * | 5/2012 | Munz | A45D 34/041 604/20 |
| 2012/0177429 | A1 * | 7/2012 | Martinez De San Vicente Oliveras | A45D 26/0014 401/1 |
| 2012/0246856 | A1 * | 10/2012 | Screnci, Jr. | A45D 27/04 15/160 |
| 2013/0118515 | A1 * | 5/2013 | Wurtz | A46B 11/08 132/200 |
| 2015/0201736 | A1 * | 7/2015 | Staggs | A46B 11/08 401/1 |

* cited by examiner

HEATED SHAVING BRUSH ASSEMBLY

1. OTHER RELATED APPLICATIONS

The present application is a continuation-in-part pending of U.S. patent application Ser. No. 13/749,901, filed on Jan. 25, 2013, which is hereby incorporated by reference.

BACKGROUND OF THE INVENTION

1. Field of the Invention

The present invention relates to a shaving cream brush and, more particularly, to a shaving cream brush with a heating element to raise the temperature of the shaving cream before it is expelled through the bristles.

2. Description of the Related Art

Several designs for a shaving cream brush have been designed in the past. None of them, however, include a heating element to heat the shaving cream as it travels through the interior space of the brush.

Applicant believes that a related reference corresponds to U.S. Pat. No. 3,388,958 issued to William Johnson. However, it differs from the present invention because the Johnson reference does not teach of heating the shaving cream as it travels through the conduits in the interior space of the brush. Also, the Johnson reference does not teach of a removable bristle assembly. Moreover, the Johnson reference does not disclose a means to adjust the pressure of the shaving cream being inserted into the brush. The present invention also includes a heating element that does not require a battery in the brush and a thermostat member not taught or motivated by the Johnson reference.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a heating shaving brush that raises the temperature of the shaving cream being applied to a user's face to better prepare for a smoother shave.

It is another object of this invention to provide a charging station using alternating current to heat up the shaving brush.

It is still another object of the present invention to provide a heating shaving brush including an adjustment dial to regulate the pressure of the shaving cream traveling through the shaving brush.

It is another object of the present invention to provide a heating shaving brush having a removable bristle assembly.

It is another object of the present invention to provide a brush with a heating element that does not require a battery.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 8 shows a front elevational view with a cross-section view of the present invention wherein shaving cream pressure adjustment assembly 80 has been adjusted (rotated) downward towards the shaving cream dispenser so that bottom end 47*a* will exert a greater pressure against nozzle N to open cap 120 more and allow more shaving cream to flow through.

DETAILED DESCRIPTION OF THE EMBODIMENTS OF THE INVENTION

Figure 1:
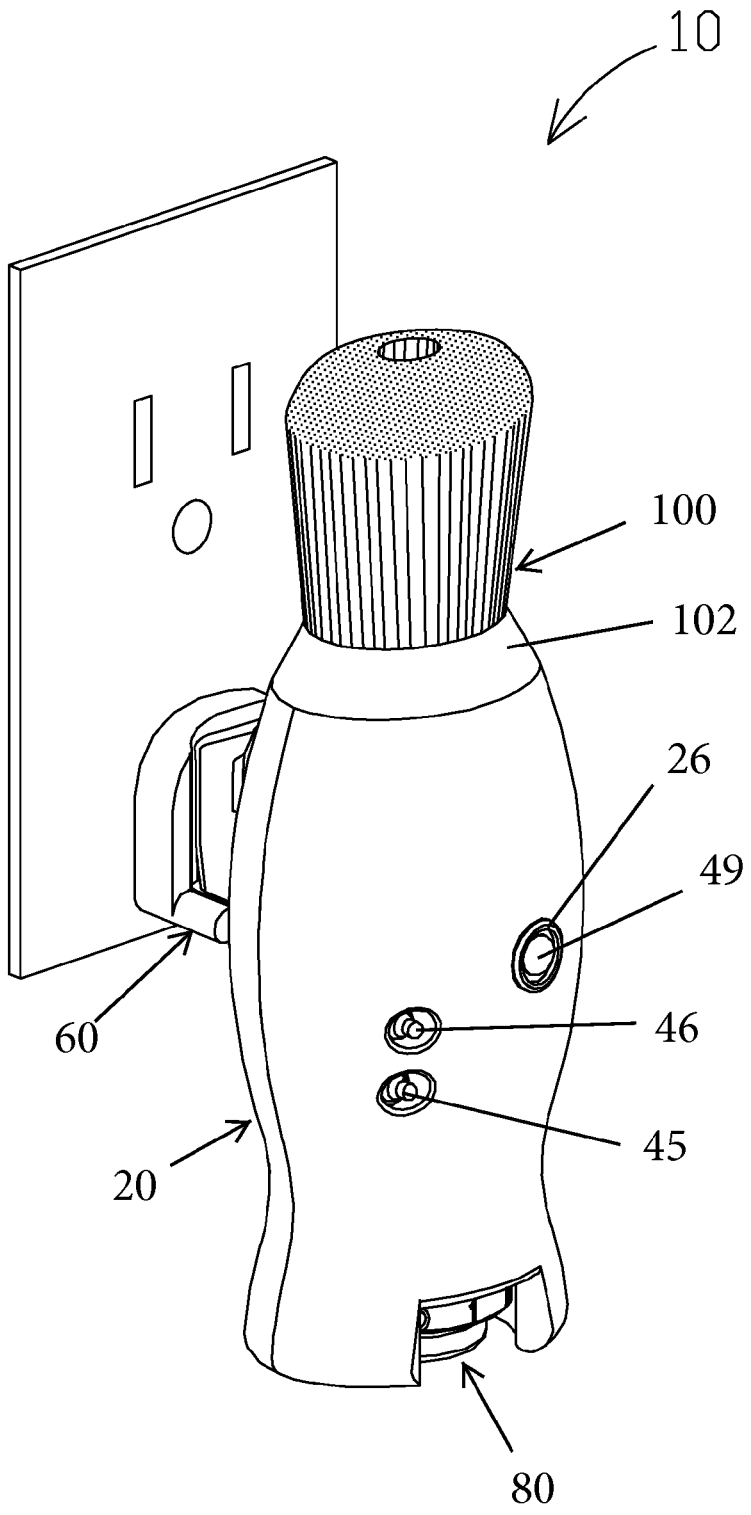
FIG. 1 represents an isometric view of the present invention with the bristle assembly mounted thereon.

Referring now to the drawings, where the present invention is generally referred to with numeral 10, it can be observed that it basically includes housing assembly 20, shaft assembly 40, charger assembly 60, shaving cream pressure adjustment assembly 80, and bristle adjustment assembly 100.

Figure 2:
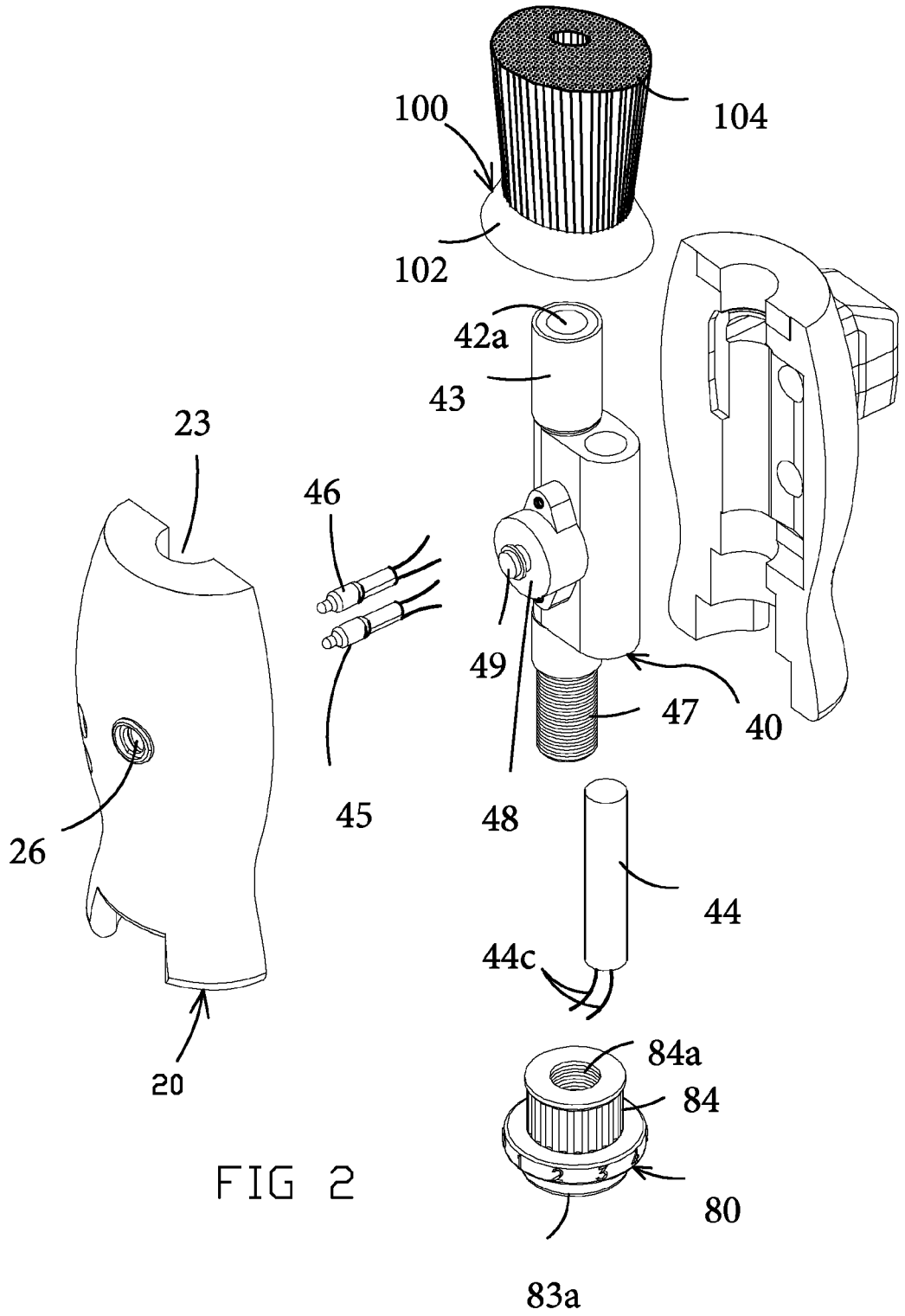
FIG. 2 shows an exploded view of the present invention showing thermostat button 49, power indicator 46 and temperature indicator 45 mounted to shaft assembly 40.
Figure 2A:
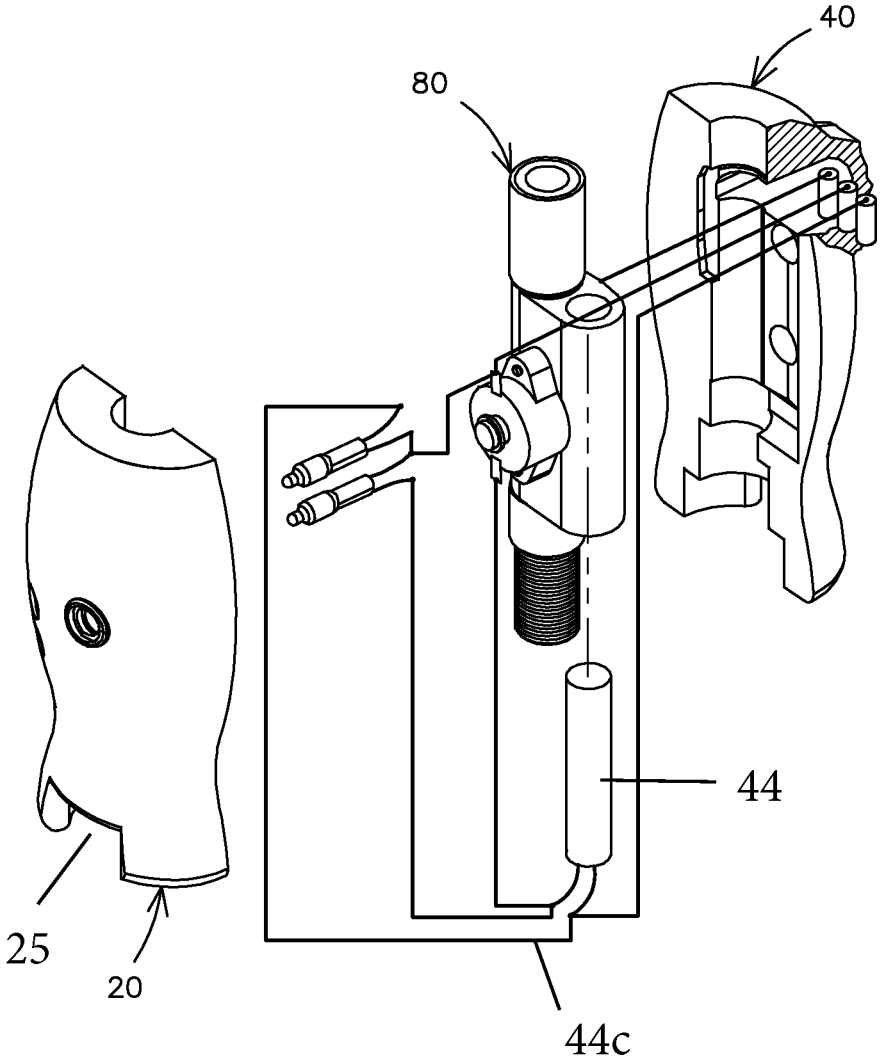
FIG. 2A represents a schematic of the electrical components of the present invention.

As shown in FIG. 2, housing assembly 20 includes first housing portion 22 and second housing portion 24 each of substantially the same dimension and both cooperating to define housing assembly 20 with interior space 27 therein. First housing portion 22 includes first top distal end 22*a* and a first bottom distal send 22*b* spaced apart by the body of first housing portion 22. First top distal end 22*a* includes cutout 23 and first bottom distal end 22*b* includes cutout 25. First housing portion 22 includes thermostat opening 26 and power indicator opening 28. In a preferred embodiment, thermostat indicator opening 26 and power indicator opening 28 are adjacent to each other.

Figure 3:
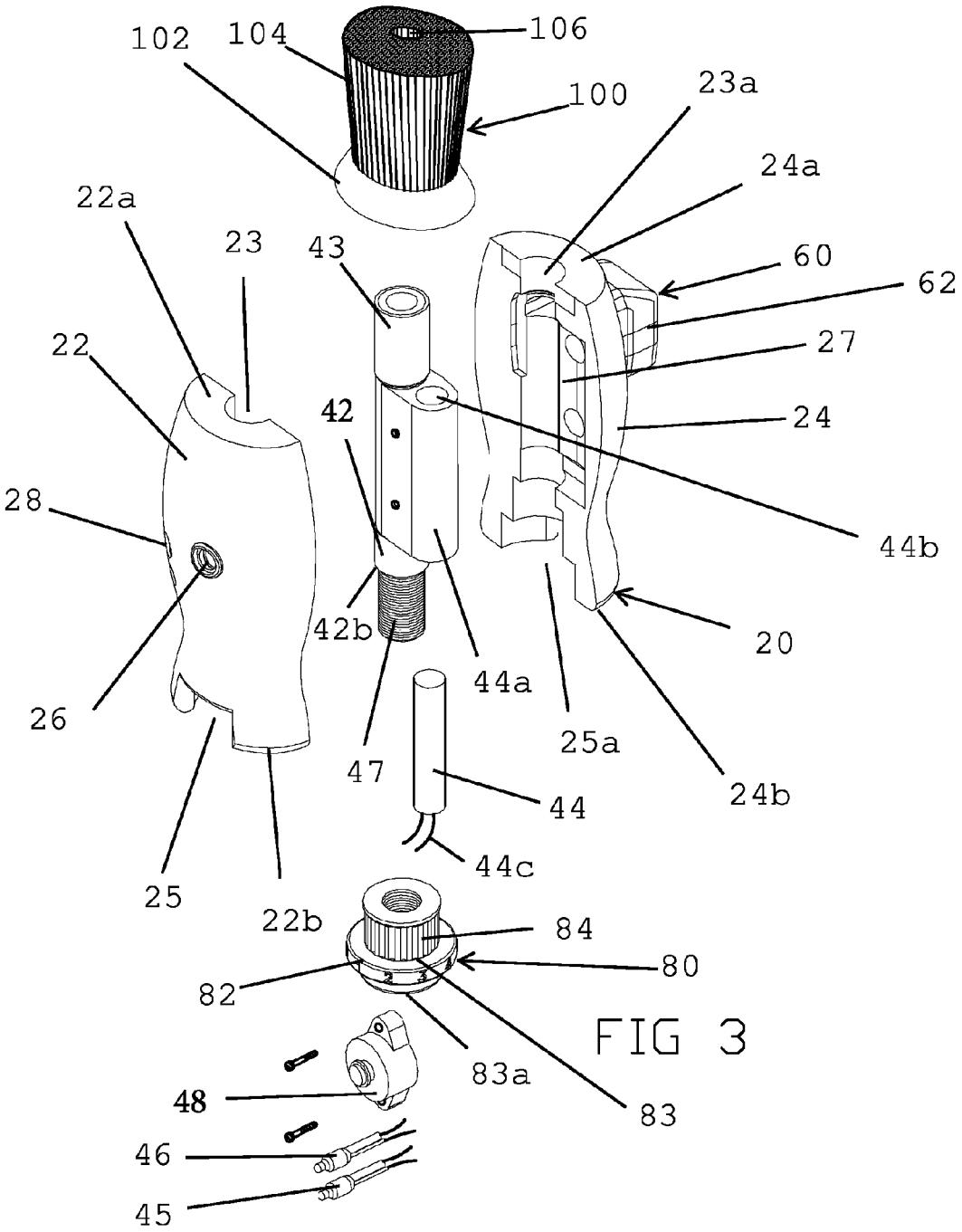
FIG. 3 illustrates an exploded view of the present invention having thermostat button 49, power indicator 46, and temperature indicator 45 removed from shaft assembly 40 to show their mounting points.
Figure 3A:
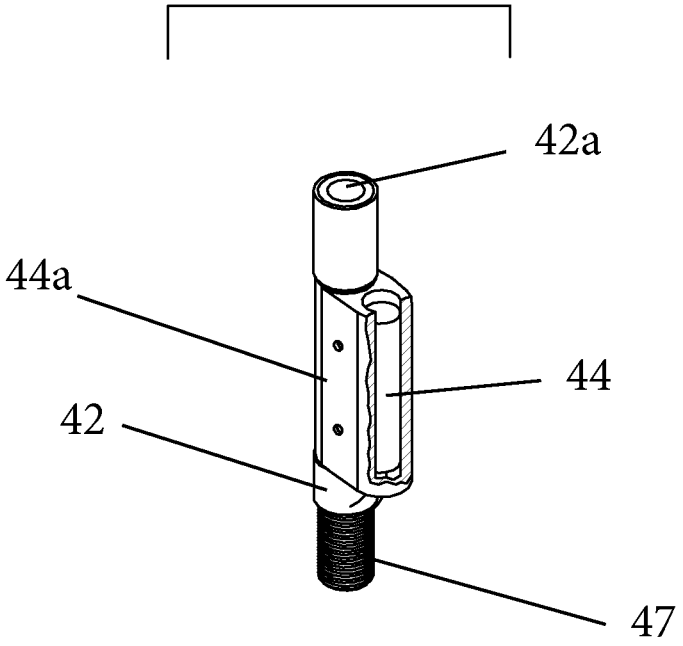
FIG. 3A is an isometric view of shaft assembly 40 showing a cross-section of heating element mounting unit 44*a* showing heating element 44 mounted therein.

As shown in FIGS. 2 and 3, second housing portion 24 includes second top distal end 24*a* and second bottom distal end 24*b* at opposite ends thereof. Second top distal end 24*a* includes cutout 23*a* and second bottom distal end 24*b* includes cutout 25*a*. As seen in FIG. 3, shaft assembly 40 includes longitudinal, hollow shaft member 22 that is housed within interior space 27 of housing assembly 20. Hollow shaft member 42 houses tube 41 to allow shaving cream or a lubricating agent to efficiently pass through. Shaft assembly 40 further includes shaft top surface 42*a* and shaft bottom surface 42*b*. Shaft top surface 42*a* includes protective cuff 43 extending therefrom to reduce passing through it.

Shaft assembly 40 includes heating element 44 mounted at a predetermined location along shaft member 42. In a preferred embodiment shown in FIG. 2, heating element 44 is mounted within mounted unit 44*a* having opening 44*b* that allows heating element 44 to be housed therein and come in abutting contact with hollow shaft member 42, thereby heating the shaving cream passing through. Heating element 44 also includes wires 44*c* that connect to the complementing terminals on second housing portion 24. When the present invention is receiving alternating or direct current heating element 44 heats up to a predetermined temperature sufficient to increase the effectiveness of the lubricating agent or shaving cream while not being hot enough to cause a user discomfort. Heating element 44 can be covered using insulation to store its heat.

As seen in FIG. 3, shaft member 42 also includes thermostat 48 mounted thereon that measures the temperature of heating element 44 and when a predetermined temperature is reached, it triggers temperature indicator 45 to light up. This indicates to a user that the unit is ready for use at the preferred temperature for heating element 44. Power indicator 46 is adjacent to temperature indicator 45 and informs a user when the unit is receiving power (from the outlet or battery). In a preferred embodiment, shown in FIG. 2, thermostat 48 is mounted to the outside surface of mounting unit 44*a*. This indicates to a user that the unit is ready for use. Power indicator 46 is adjacent to temperature indicator 45 and informs a user when the unit is receiving power. Thermostat 48 includes thermostat button 49 mounted thereon. When thermostat 48 reaches a predetermined temperature it pushes out thermostat button 49 to indicate that the electrical connection between thermostat 48 and the outlet or battery. When a user wants heating element 44 to begin heating up again, thermostat button 49 needs to be pushed back in.

Figure 4:
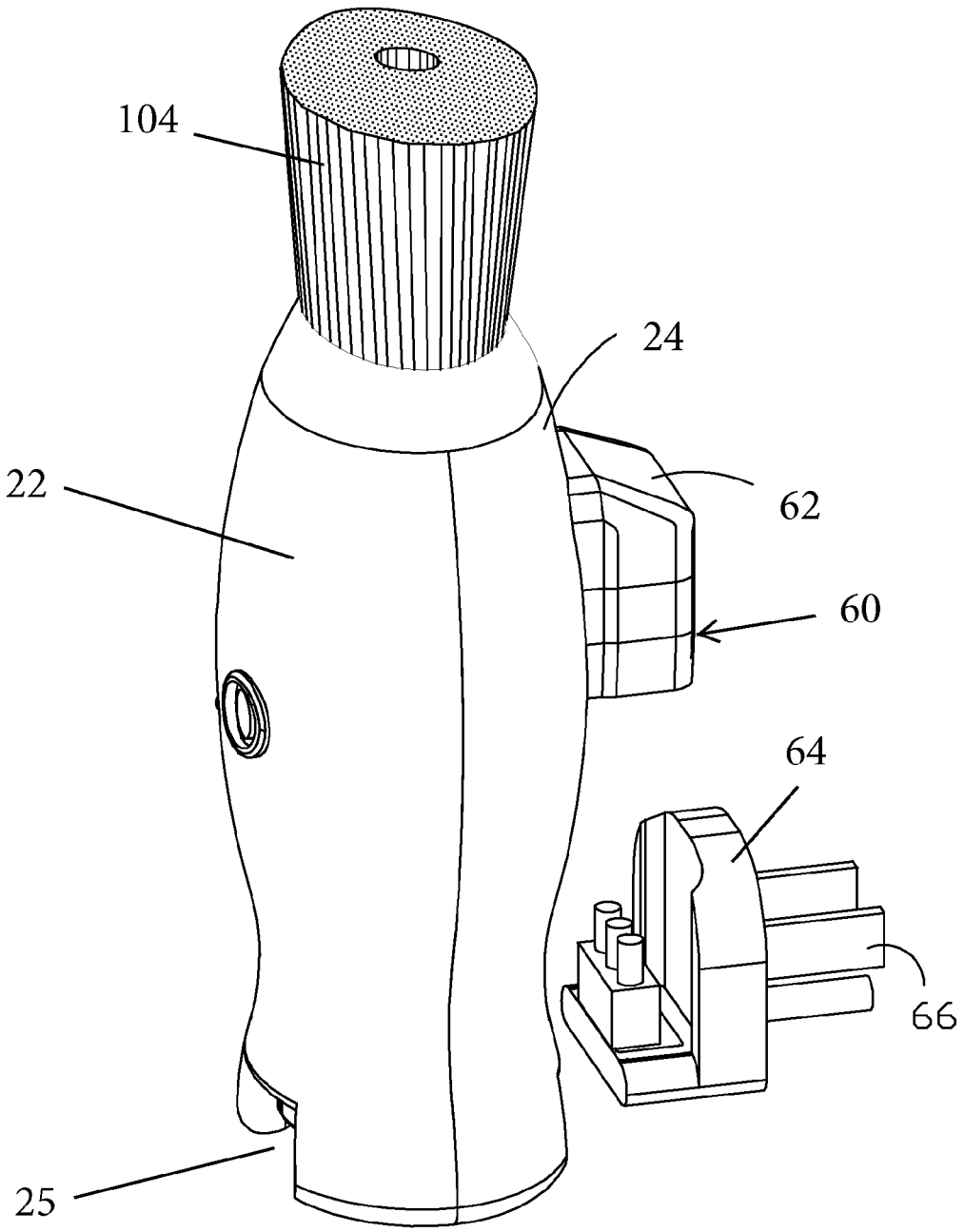
FIG. 4 is a representation of a side isometric view of the present invention wherein female charging member 62 is seen removed from male charging member 64.
Figure 5:
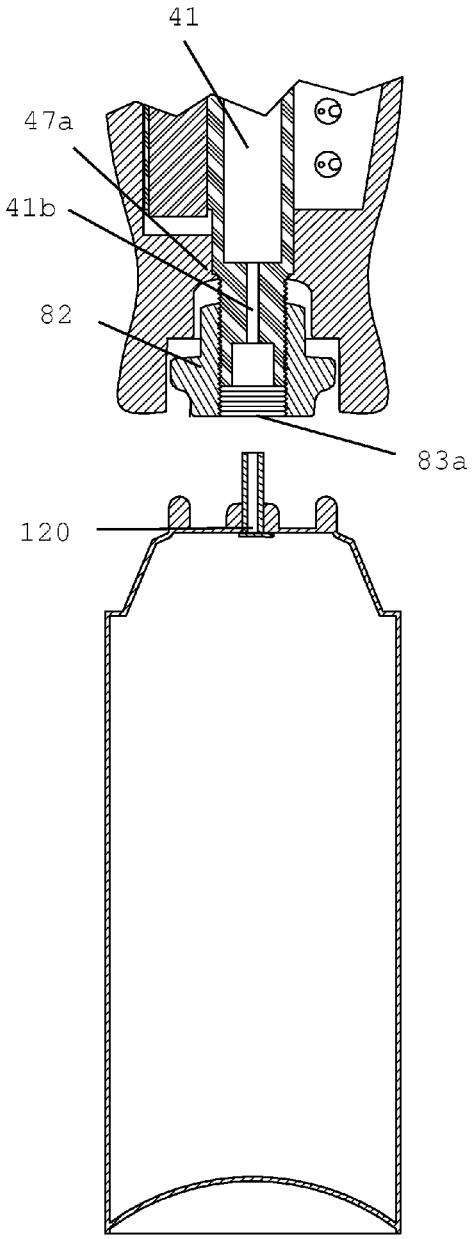
FIG. 5 is a front elevational view showing a cross-section of the present invention wherein the present invention has been removed from the shaving cream dispenser.
Figure 6:
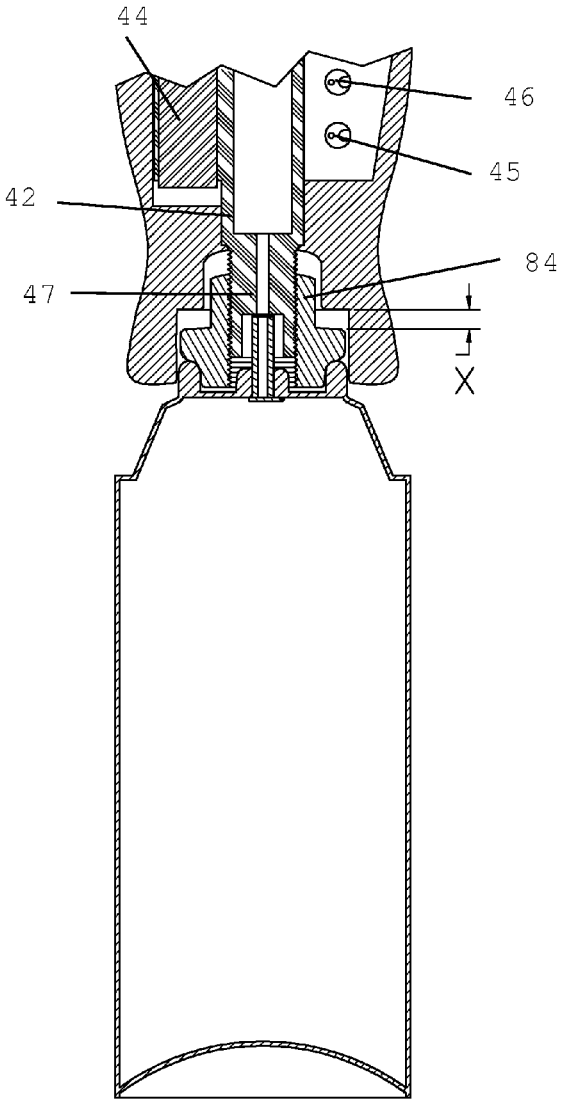
FIG. 6 is a front elevational view showing a cross-section of the present invention wherein the present invention has been inserted into a shaving cream dispenser. Nozzle N of the shaving cream dispenser can be seen coming into abutting contact with tube extension 41*b*.
Figure 7:
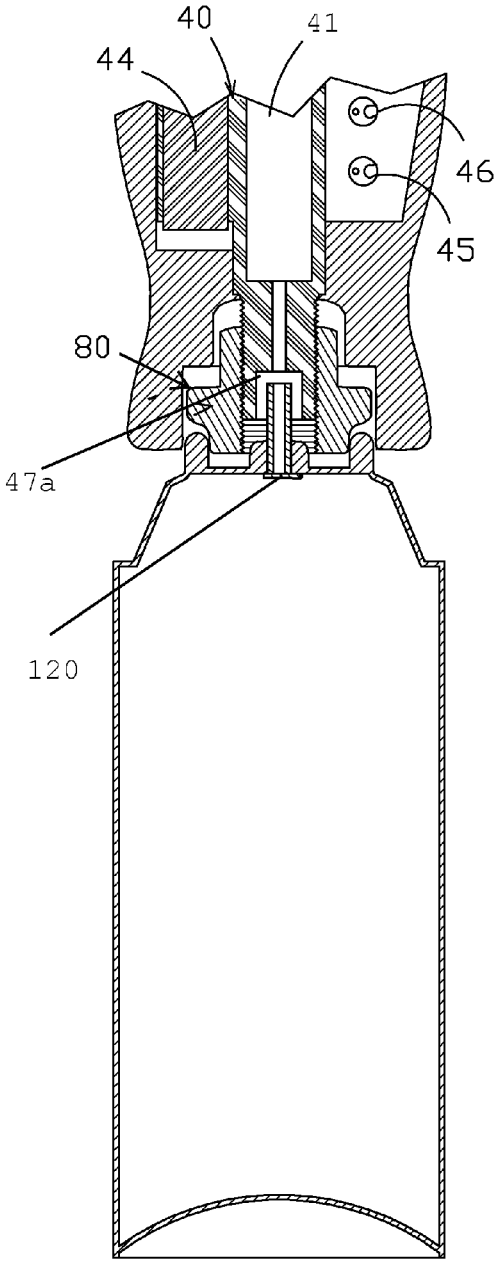
FIG. 7 is a front elevational view showing a cross-section of the present invention wherein shaving cream pressure adjustment assembly 80 has been rotated away from the shaving cream dispenser thereby limiting the amount of bottom end 47*a* that can come into contact with shaving cream nozzle N when a user applies a force on the present invention towards it.
Figure 8:
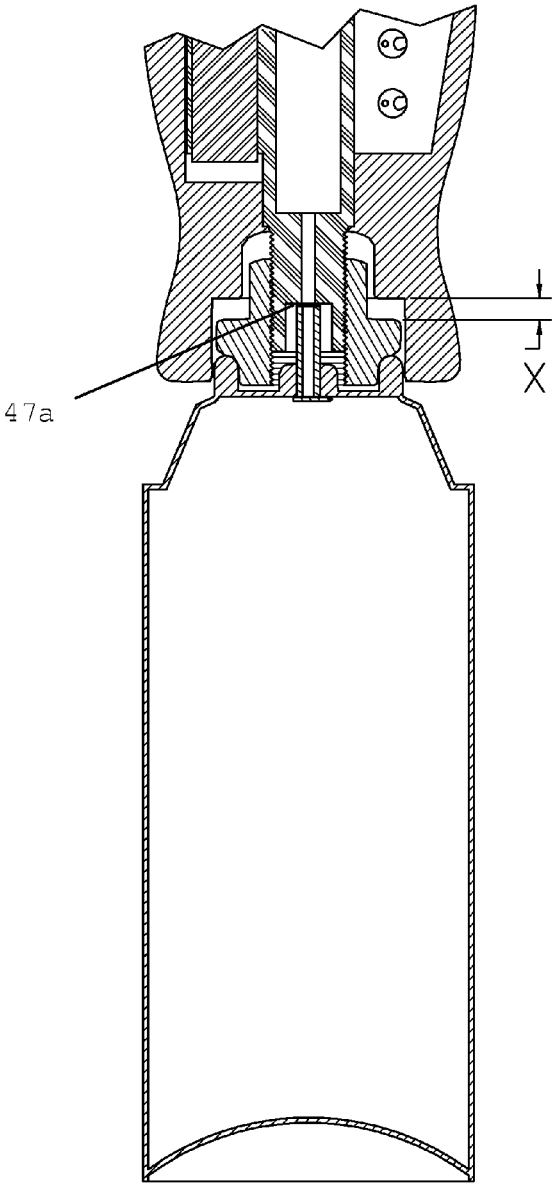
Figure 9:
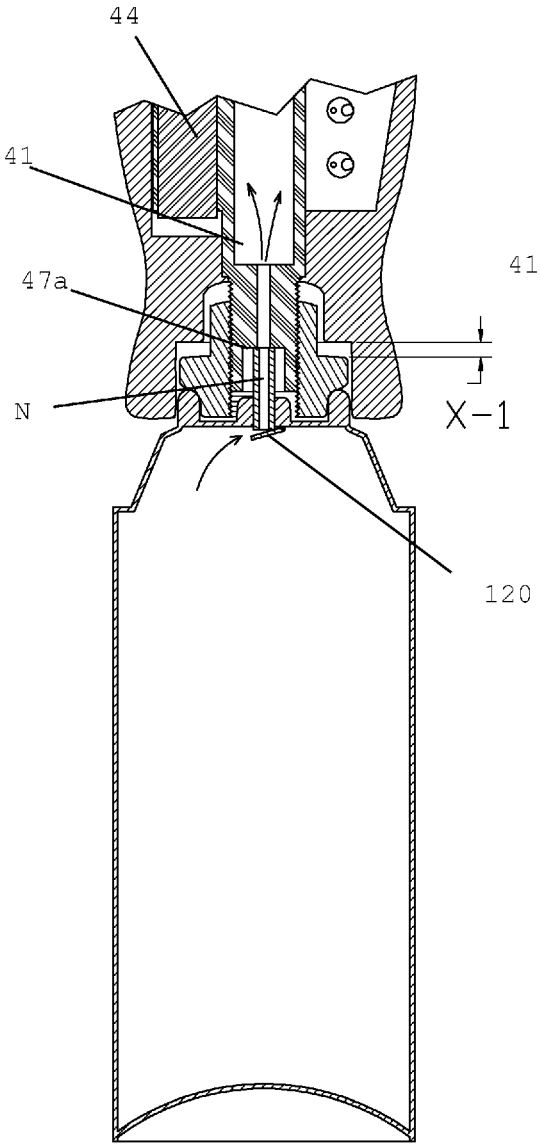
FIG. 9 represents a front elevational view with a cross-section view of the present invention wherein shaving cream pressure adjustment assembly 80 is in a position where a user has rotated it away from the shaving cream dispenser. In this view, a user is applying a predetermined amount of force downwards on the present invention onto a shaving cream dispenser to allow the shaving cream to flow into tube extension 41*b*.
Figure 10:
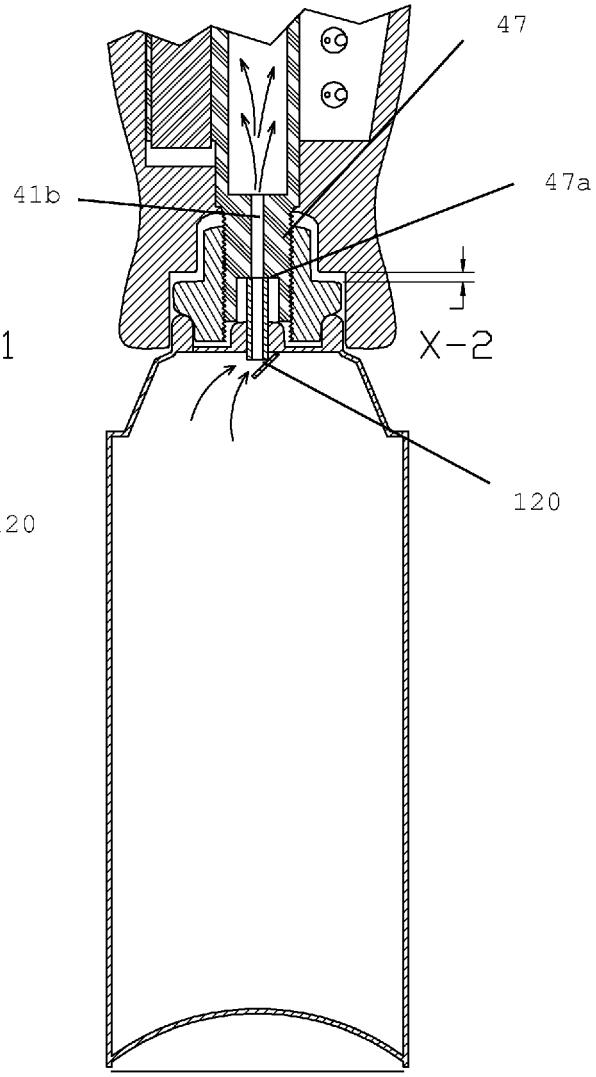
FIG. 10 shows a front elevational view with a cross-section view of the present invention wherein shaving cream pressure adjustment assembly 80 is in a position where a user has rotated it towards the shaving cream dispenser. In this view, a user is applying a predetermined amount of force downwards on the present invention onto a shaving cream dispenser to allow the shaving cream to flow into tube extension 41*b*. Since shaving cream pressure adjustment assembly 80 was closer to nozzle N a user's downward force was able to create an even larger force against nozzle N and thus a larger force against cap 120, thereby allowing a greater amount of shaving cream to flow out than the amount shown in FIG. 9.

Shaft bottom surface 42*b* has threaded screw 47 extending therefrom that is cooperatively mounted to shaving cream pressure adjustment assembly 80. Threaded screw 47 includes a bottom end 47*a* that cooperates to push down on nozzle N of a shaving cream dispenser when a user applies a sufficient amount of force. The force against nozzle N causes it to push against the valve cap of the shaving cream dispenser, thereby allowing the shaving cream to flow into tube 41 of the present invention. As shown in FIG. 4, charging assembly 60 is mounted to a predetermined location on the outside surface of second housing portion 24 and includes female charging member 62 that connects to male charging member 64 to transmit power to the device. Male charging member 64 is connected to a battery or an outlet to send direct or alternating current, respectively, to power the device. Male charging member 64 can include prongs 66 used to connect it to an outlet.

Shaving cream pressure adjustment assembly 80 includes graduated knob 82 mounted to threaded extension 84 at first end 83. As shown in FIG. 3, threaded screw 47 can cooperate with threaded extension 84 to create a secure engagement, thereby mounting shaft assembly 40 to shaving cream pressure adjustment assembly 80. Second end 83*a* includes a shaving cream inlet port 41 that cooperates with nozzle N of a shaving cream canister to receive shaving cream.

A user continues to push the shaving cream canister into the inlet port until the desired amount is expelled into the device and pushed into bristle assembly 100. The amount the shaving cream is heating can be controlled by graduated knob 82. When a user rotates graduated knob away from the shaving cream dispenser the shaving cream passes slower through shaft member 42 because a user will not be able to push shaving cream dispenser cap 120 down as much to allow the flow of more shaving cream. This causes the shaving cream to be heated up longer while in shaft assembly 40. The shaving cream passes slower because when graduated knob 82 is rotated it moves higher up on threaded extension 84, therefore, it is farther from nozzle N of the shaving cream dispenser. It would apply less pressure to nozzle N of the shaving cream can, thereby releasing less shaving cream. Alternatively, if a user rotates graduated knob 82 in the opposite direction then the shaving cream is allowed to pass faster through shaft 42, thereby not allowing the shaving cream to heat up as much. Cutouts 23; 23*a* receive protective cuff 43 when first and second housing portions 22; 24 are joined. Similarly, when first and second housing portions 22; 24 are mounted together, cutouts 25; 25*a* define a second interior space at the bottom of the unit partially housing shaving cream pressure adjustment assembly 80 therein.

When first and second housing portions are mounted together, bristle assembly 100 is mounted to first and second top distal ends 22*a*; 24*a* and extends upwards therefrom. Bristle assembly 100 includes base unit 102 that is mounted to bristles 104, as shown in FIG. 4. Bristle assembly 100 also includes opening 106 that allows the shaving cream to pass through from shaft member 42 to a user's body. Bristle assembly 100 can be removable as shown in FIG. 2 in case it needs to be washed or replaced.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A shaving brush assembly comprising:

a housing assembly including a first distal end and a second distal end and further including an interior space, a shaft assembly having a hollow shaft member positioned within said interior space, said hollow shaft member including a tube housed therein and a threaded screw extending from the bottom surface of said shaft member, said tube having a tube extension extending from the tube bottom distal end, said tube being of a predetermined diameter to allow shaving cream to flow through, a heating element adjacent to said hollow shaft member positioned at a distance close enough to said hollow shaft member to allow said shaving cream flowing through said tube to heat up a predetermined temperature, a charger assembly that provides power to said heating element, a removable bristle assembly mounted at said first distal end, and a shaving cream pressure adjustment assembly mounted on said second distal end, said shaving cream pressure adjustment assembly including a graduated knob and threaded extension, said graduated knob able to be rotated up and down said threaded screw, said tube having a first end extending into said bristle assembly and having a second end extending into said shaving cream adjustment assembly, said shaving cream pressure adjustment assembly having a bottom end that includes an inlet valve that is configured to couple to a nozzle of a shaving cream dispenser, said tube extension being of a dimension that cooperates with the flow of shaving cream flowing from said dispenser, said threaded screw having a bottom surface that pushes against said nozzle which pushes against a cap of the shaving cream dispenser to release said shaving cream an amount proportional to the force applied against said cap.

2. The invention subject of claim 1 wherein a battery is positioned within said interior space, said battery being coupled to said heating element.

3. The invention subject of claim 1 wherein said shaft assembly includes a heat indicator mounted thereto and extending through an opening in said housing assembly.

4. The invention subject of claim 1 wherein said shaft assembly includes a power indicator mounted thereto and extending through an opening in said housing assembly.

5. The shaving cream pressure adjustment assembly of claim 1 wherein said graduated knob is rotated up said threaded extension to increase the distance from said nozzle, thereby reducing the speed at which the shaving cream is dispensed into said shaft member.

6. The invention subject of claim 1 wherein a heating element mounting unit is mounted to said shaft assembly, said heating element mounting unit including a cavity wherein said heating element is inserted, said heating element within said heating element mounting unit positioned close enough to said shaft to heat said shaving cream to a predetermined temperature.

7. The invention subject of claim 1 wherein said shaft includes a thermostat mounted thereon, said thermostat includes a thermostat button that is pushed out by said thermostat when a predetermined temperature is reached, when said thermostat button is pushed out power is no longer sent to said heating element until a user pushes said button back in.

8. The housing assembly subject of claim 1 including a cut out at said second distal end to allow said shaving cream pressure adjustment assembly to be at least partially housed therein.

9. The bristle assembly subject of claim 1 further including a base member mounted to said first distal and a plurality of bristles extending from said base member, said plurality of bristles include an opening to allow said shaving cream to effectively flow therefrom.

10. The housing assembly subject of claim 1 including a power indicator opening, a temperature indicator opening, and a thermostat button opening, said shaft assembly including a power indicator that passed through said power indicator opening, a temperature indicator that passes through said temperature indicator opening, and a thermostat button that passes through said thermostat button opening.

11. The interior space subject of claim 1 including an insulating lining to maintain the heat inside the present invention.

12. The charger assembly subject of claim 1 further including a female charging member mounted to said housing assembly, said charging assembly also including a male charging member having prongs that are connected to an outlet, said female charging member connected to said male charging member to provide power to said heating element.

13. The shaving cream pressure adjustment assembly subject of claim 1 wherein said graduated knob can be rotably lowered along said threaded extension to decrease the distance between said graduated knob and said nozzle, thereby increasing the pressure on said nozzle allowing said shaving cream to be dispensed inside said hollow shaft member faster.

14. The hollow shaft member subject of claim 1 having a bottom distal end that includes a threaded screw extending therefrom, said threaded screw cooperates with said threaded extension to create a secure engagement between said shaving cream pressure adjustment assembly and said shaft assembly.

15. The hollow shaft member subject of claim 1 having a top portion that is covered by a protective sleeve.

* * * * *